United States Patent [19]

Hikita

[11] Patent Number: 4,887,347

[45] Date of Patent: Dec. 19, 1989

[54] METHOD OF PRODUCING A CONTACT SPRING STRUCTURE OF AN ELECTROMAGNETIC RELAY

[75] Inventor: Hiroshi Hikita, Kanagawa, Japan

[73] Assignee: Fuji Electric Co., Ltd., Kanagawa, Japan

[21] Appl. No.: 234,653

[22] Filed: Aug. 22, 1988

[30] Foreign Application Priority Data

Oct. 14, 1987 [JP] Japan ..... 62-259151

[51] Int. Cl.[4] ..... H01H 11/00

[52] U.S. Cl. ..... 29/602.1; 29/622; 29/882; 29/883; 29/884; 264/263; 264/275

[58] Field of Search ..... 29/602.1, 622, 882, 29/883, 884; 264/263, 275

[56] References Cited

U.S. PATENT DOCUMENTS

| | | | |
|---|---|---|---|
| 3,704,514 | 12/1972 | Fuchs et al. | 29/602.1 |
| 4,197,804 | 4/1980 | Uhlig et al. | 29/882 |
| 4,388,757 | 6/1983 | Takeyama et al. | 29/883 |
| 4,490,903 | 1/1985 | Agalahama | 29/622 |

*Primary Examiner*—P. W. Echols
*Assistant Examiner*—K. Jordon
*Attorney, Agent, or Firm*—Finnegan, Henderson, Farabow, Garrett and Dunner

[57] ABSTRACT

A method of producing a plurality of individual contact spring assemblies for use in an electromagnetic relay in which movable and fixed contact springs for each assembly are held by a molded resin base comprises the steps of caulking a first set of contacts and a second set of contacts to a unitary sheet metallic blank and stamping out the movable and fixed contact springs from the metallic blank. The method further comprises the steps of bending the stamped-out movable and fixed contact springs into a predetermined configuration such that the fixed and movable contact springs are in opposition to each other and molding a base so that selected portions of the movable and fixed contact springs are embedded therein. Finally, the method comprises the step of cutting the fixed and movable contact springs from the metallic blank.

3 Claims, 4 Drawing Sheets

METHOD OF PRODUCING A CONTACT SPRING STRUCTURE OF AN ELECTROMAGNETIC RELAY

FIELD OF THE INVENTION

The present invention generally relates to an electromagnetic relay, and particularly to a method of producing a contact spring apparatus of a micro electromagnetic relay such as a control relay mounted on a printed circuit board.

BACKGROUND OF THE INVENTION

Conventionally, a contact spring structure of an electromagnetic relay has been produced in such a manner that a movable contact spring and a fixed contact spring are formed separately from each other and are then assembled on a base by pressing-in, embedding-molding, or the like.

The electromagnetic relay used as a control relay for an input/output interface of an electric circuit or the like is required to be miniaturized because general electronic parts have been miniaturized or highly integrated. Therefore, a micro control relay, for example, having an outside size of 5 mm (thickness)×20 mm (width)×18 mm (height) has been produced. Handling of contact springs of such a micro relay is difficult because a movable contact spring is so thin and small as to be, for example, about 0.08 mm in thickness, about 3 mm in width, and about 18 mm in length. Then, the conventional producing method, in which a movable contact spring and a fixed contact spring are formed separately from each other and then assembled on a base, has a problem in that not only is productivity poor but low reliability results from defective assembling.

SUMMARY OF THE INVENTION

It is therefore an object of the present invention to solve the foregoing problem in the prior art.

Another object of the present invention is a method of efficiently producing a contact spring structure of an electromagnetic relay.

Still a further object of the present invention is a method of producing high quality contact spring structures for an electromagnetic relay.

In order to attain these and other objects, according to the present invention, a method of producing a contact spring structure of an electromagnetic relay in which a movable contact spring and a fixed contact spring are held in opposition to each other by a molded resin base comprises the steps of stamping out a movable contact spring and a fixed contact spring from a plate of material such that the movable and fixed contact springs are partly connected to each other through a connection portion, bending the stamped-out movable and fixed contact springs to be in opposition to each other with a predetermined configuration, embedding the movable and fixed contact springs in a molded base, and cutting off the connecting portion after molding of the base.

According to the present invention, the movable and fixed contact springs are embedded when the movable and fixed contact springs are formed integrally with each other, and are separated from each other after molding of the base. In this manner, the handling of the contact springs is made easy and more workable and the positional relationship between the movable and fixed contact springs can be uniformly maintained.

BRIEF DESCRIPTION OF THE DRAWINGS

The manner by which the above objects and other objects, features, and advantages of the present invention are attained will be apparent from the following detailed description taken in conjunction with the accompanying drawings, wherein.

DETAILED DESCRIPTION OF THE DRAWINGS

Figure 8:
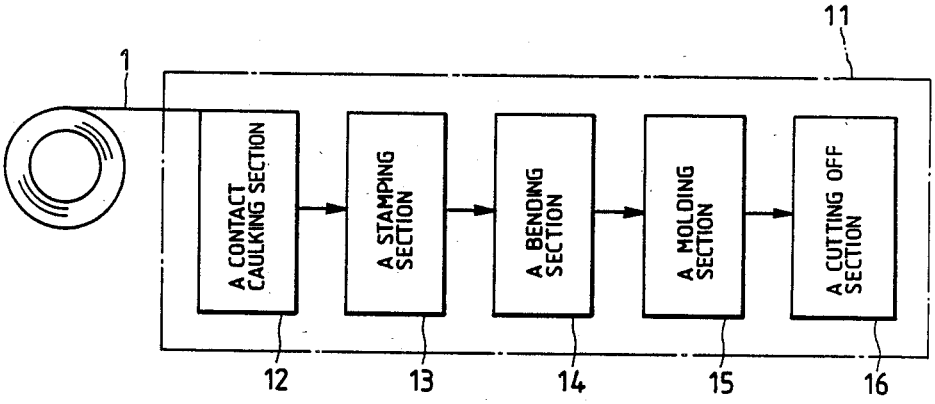
FIG. 8 is a conceptual view of an apparatus for use in carrying out the process of the present invention.

FIGS. 1, 2(A), 2(B), 3(A) and 3(B) show a first embodiment of a contact spring structure produced by the method according to the present invention in the order of the manufacturing steps, and FIG. 8 conceptually shows an automated apparatus for producing the contact spring structure by using the method according to the present invention.

Figure 1:
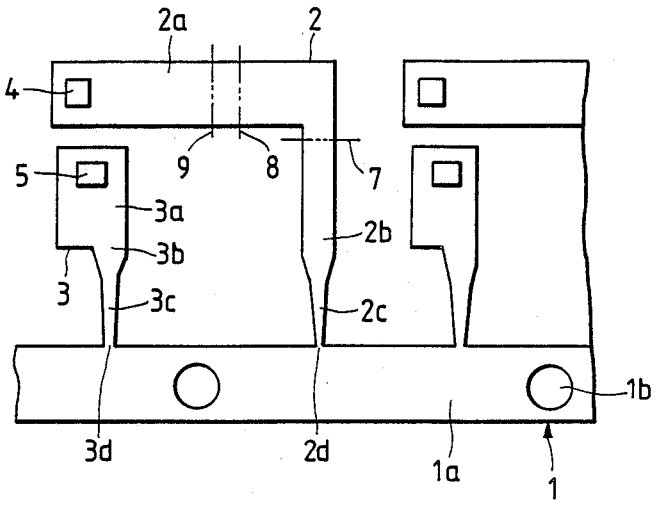
FIG. 1 is a plan view for explaining the stamping step.

FIG. 1 shows a state of movable and fixed contact springs 2 and 3 stamped out from a plate material 1 with an illustrated configuration. The plate material 1 may be a long belt of phospher bronze plate having a thickness of 0.08 mm coiled into a so-called hoop material as shown in FIG. 8. The plate material 1 is subject to working continuously from one end.

Prior to the stamping step of FIG. 1, a pair of movable and fixed contacts 4 and 5 are caulked on the plate material 1 at the illustrated positions of a portion where a pair of movable and fixed contact springs 2 and 3 are to be formed in the stamping step. Pairs of the contacts 4 and 5 are successively caulked, at a contact caulking section 12 of a manufacturing apparatus 11 conceptually shown in FIG. 8, on the plate material 1, which is automatically fed.

The plate material 1, with the contacts 4 and 5 attached in the contact caulking section 12, is fed to a stamping section 13 so as to be stamped out into the configuration as shown in FIG. 1. The contact springs 2 and 3 are respectively provided with contact body portions 2*a* and 3*a* carrying the contacts 4 and 5, respectively. Support portions 2*b* and 3*b* are provided and are embedded in, and supported by, a base 6 as will be described later. Terminal portions 2*c* and 3*c* are adapted to be inserted into a printed circuit board or the like. The contact body portion 2*a* of the movable contact spring 2 is formed in an elongated shape as illustrated in FIG. 1 so as to change elastically in shape during the opening and closing of a relay.

Positioning holes 1b for automatically feeding the plate material 1 are formed at regular intervals in a material portion 1a, which is a remainder portion of the plate material 1 after stamping. Even after stamping, the contact springs 2 and 3 are connected to each other through the portion 1a at connecting portions 2d and 3d of top end portions of the terminal portions 2c and 3c.

Figure 2A:
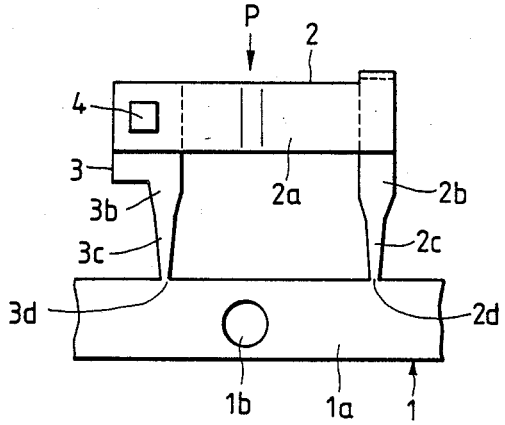
FIG. 2(A) is a plan view for explaining the bending step.
Figure 2B:
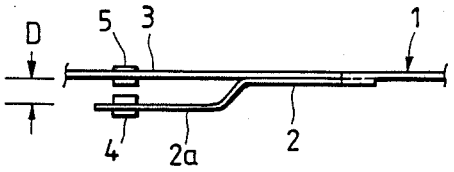
FIG. 2(B) is a front view when viewed in the direction of an arrow P of FIG. 2(A)

After the movable and fixed contact springs 2 and 3 have been formed on the plate material 1 by stamping, the springs are fed to a bending section 14 of FIG. 8 in which the movable contact spring 2 is bent in this illustrated embodiment. The bending is performed so that the contact springs 2 and 3 formed in a plane from the plate material 1 by stamping are made to be disposed in opposition to each other in a predetermined three dimensional configuration. In order to obtain such a configuration as shown in FIGS. 2(A) and 2(B), the movable contact spring 2 is bent and folded back at a bending line 7 in FIG. 1. The movable contact spring 2 is then bent upward a little at a bending line 8, and then bent back at a bending line 9 so as to again be parallel with the fixed contact spring 3. As a result, the movable contact spring 2 and the fixed contact spring 3 are held in opposition to each other and are separated by a predetermined space D as shown in FIG. 2(B) to perform an on-off operation between the contacts 4 and 5.

Figure 3A:
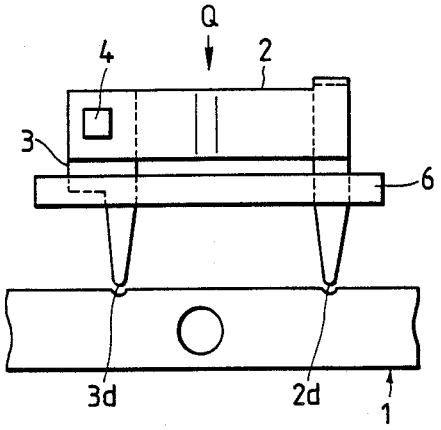
FIG. 3(A) is a plan view for explaining the molding step and the cutting-off step.
Figure 3B:
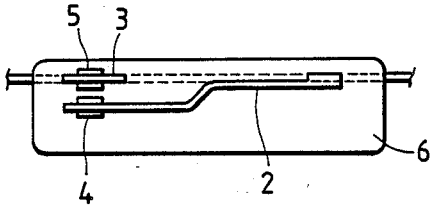
FIG. 3(B) is a front view when viewed in the direction of an arrow Q of FIG. 3(A)

The bent movable contact spring 2 and the fixed contact spring 3 are sent to a molding section 15 of FIG. 8 in which the molding of the base 6 shown in FIGS. 3(A) and 3(B) is formed so that the contact springs 2 and 3 are embedded in the base 6. The molding may be performed by placing the support portions 2b and 3b of the contact springs 2 and 3 into a mold of an injection molding machine (not shown) and flowing thermoplastic resin such as PDT or the like into the mold. The resin is then cured.

The movable and fixed contact springs 2 and 3 supported by the molded base 6 are sent to a cutting-off section 16 of FIG. 8 in which the connecting portions 2d and 3d are cut off from the plate material 1 as shown in FIG. 3(A). As a result, the movable contact spring 2 is electrically separated from the fixed contact spring 3.

An electromagnetic unit constituted by a coil, a yoke, an armature, or the like, is fixed by pressure insertion to the base 6 of a contact spring structure in which the contact springs 2 and 3 are held by the base 6 as described above, and a dust preventing cover is attached thereto to complete the electromagnetic relay. The movable contact spring 2 is connected to the armature by a driving plate so that an on-off operation is performed between the movable and fixed contact springs 2 and 3.

FIGS. 4 to 7 show the steps of the method of the present invention for producing another embodiment of an electromagnetic relay. In these figures, items corresponding to those of the foregoing FIGS. 1–3 are correspondingly referenced.

Figure 4:
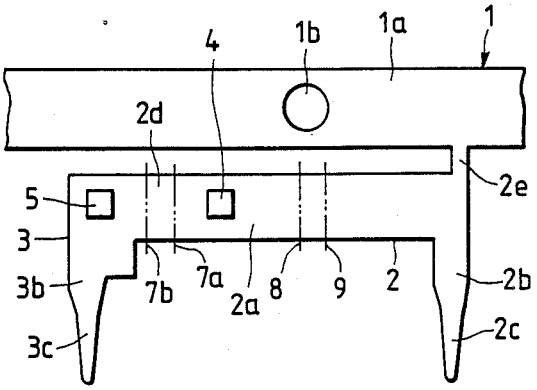
FIG. 4 is a plan view for explaining the stamping step.

FIG. 4 shows a state where the stamping step has been performed. In this embodiment, a movable contact spring 2 is directly connected at a connecting portion 2d to a fixed contact spring 3. Further, the movable contact spring 2 is connected at a connecting portion 2e to a material portion 1a.

Figure 5A:
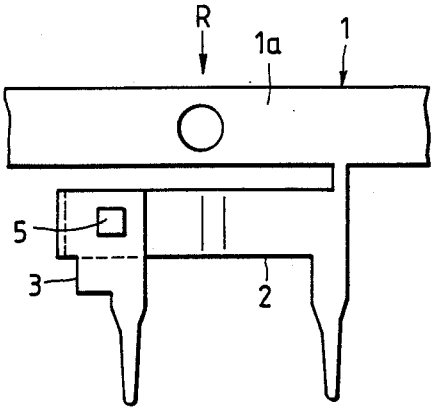
FIG. 5(A) is a plan view for explaining the bending step.
Figure 5B:
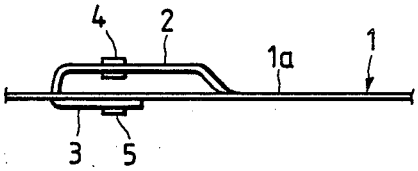
FIG. 5(B) is a front view when viewed in the direction of an arrow R of FIG. 5(A)

FIGS. 5(A) and (B) show a state where the bending step has been performed. The bending step is performed in such a manner that the fixed contact spring 3 is bent upward at a bending line 7a in FIG. 4 so as to become perpendicular to the plane of the drawing, and is then further bent at a bending line 7b to become parallel with the movable contact spring 2. Then, the portion of the movable contact spring 2 where the movable contact 4 has been attached is bent upward at a bending line 8, and then bent back at a bending line 9 so as to again become parallel with the fixed contact spring 3.

Figure 6:
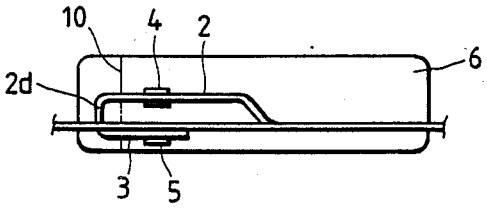
FIG. 6 is a front view for explaining the molding step.
Figure 7:
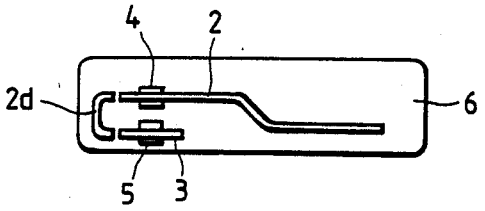
FIG. 7 is a front view for explaining the cutting-off step.

FIG. 6 shows a state where a base 6 has been molded, and FIG. 7 shows a state where the cutting-off step has been performed. In the cutting-off step, the movable contact spring 2 is cut off at its connecting portion 2d along a cutting line 10 of FIG. 6 and further cut off at its connecting portion 2e so as to be separated from the material portion 1a.

The method of producing a contact spring structure according to the present invention is particularly suitable for automation, and therefore continuous work can be performed efficiently by using an automatic machinery. In the case of a single work unit, after the stamping step, the separation between the movable and fixed contact springs is performed at the material portion 1a in the first embodiment, and at the connection portion 2e in the second embodiment. Because the movable contact spring 2 and the fixed contact spring 3 are integrally connected with each other before the molding step, the handling is very easy even in the case of such a single working unit, in comparison with the case where the movable and fixed contact springs 2 and 3 are formed separately from each other.

Further, in either case of the foregoing embodiments, the material portion 1a after stamping may be cut to suitable predetermined length so that plural sets of contact springs 2 and 3 are collectively handled.

Additional advantages and modifications will readily occur to those skilled in the art. The invention is its broader aspects is, therefore, not limited to the specific details, representative apparatus and illustrative example shown and described. Accordingly, departures may be made from such details without departing from the spirit or scope of the general inventive concept as defined by the appended claims and their equivalents.

What is claimed is:

1. A method of producing a plurality of individual contact spring assemblies, each having a movable and a fixed contact spring, comprising:

providing a unitary sheet metallic blank having a longitudinally extending edge;

caulking a plurality of spaced first electrical contacts on one surface of the blank along a first path spaced a first predetermined distance from the longitudinally extending edge;

caulking a plurality of spaced second electrical contacts on said one surface along a second path extending substantially parallel to the first path and spaced a second predetermined distance from the longitudinally extending edge, each first contact being aligned with a corresponding second contact in a direction substantially perpendicular to the first and second paths;

stamping the unitary sheet metallic blank into a configuration wherein each of said first electrical contacts is located on each of a plurality of first spaced elongate spring members extending from between a third predetermined distance from the longitudinally extending edge to a fourth distance intermediate the first and second paths, and each of said second electrical contacts is located on a second portion on each of a plurality of second elongate spring members having a first portion extending in a direction substantially parallel to the first elongate spring members and spaced therefrom, and the second portion extending in the direction of the first and second paths;

bending each second elongate spring member along a first line parallel to and between the first and second paths for aligning the second electrical contacts in opposing relationship to the corresponding first electrical contacts;

bending each second portion of the second elongate spring members along parallel lines located intermediate the first portion and the second electrical contact and extending in a direction substantially perpendicular to the first line for spacing each second electrical contact from the corresponding opposing first electrical contact;

embedding the first and the second elongate spring members in a base for fixedly mounting the first and the second elongate spring members relative to one another; and cutting the embedded sheet metallic blank along a line substantially parallel to the first and second paths adjacent the longitudinally extending edge for separating the individual contact spring assemblies from the metallic blank.

2. The method according to claim 1, further including the step of forming a positioning hole in the unitary sheet metallic blank for automatically feeding the metallic blank after the stamping step.

3. The method according to claim 1, wherein the embedding step includes flowing a thermoplastic resin about the first and second elongate spring members.

* * * * *